United States Patent [19]

Carberry

[11] Patent Number: 4,495,899

[45] Date of Patent: Jan. 29, 1985

[54] LOW PRESSURE RELIEF VALVE ASSEMBLY FOR HIGH PRESSURE BOILER

[76] Inventor: Victor V. Carberry, X N55 W21404 Logan Dr., Menomonee Falls, Wis. 53051

[21] Appl. No.: 599,016

[22] Filed: Apr. 11, 1984

[51] Int. Cl.[3] ..... F22B 37/42

[52] U.S. Cl. ..... 122/504; 122/1 R; 122/4 R; 122/448 R; 237/9 R

[58] Field of Search ..... 122/504, 448 B, 459, 122/4 R, 1 R, 506, 448 R; 237/9 R, 65; 236/13

[56] References Cited

U.S. PATENT DOCUMENTS

| | | | |
|---|---|---|---|
| 3,294,069 | 12/1966 | Smith | 122/1 R |
| 3,949,936 | 4/1976 | Boyer et al. | 237/9 R |
| 4,258,668 | 3/1981 | Bekedani | 122/1 R |
| 4,290,389 | 9/1981 | Palchik | 122/1 R |
| 4,421,068 | 12/1983 | Aral | 122/448 B |

*Primary Examiner*—Edward G. Favors

[57] ABSTRACT

Apparatus for providing for low pressure operation of a high pressure boiler including a low pressure relief valve mounted on the boiler and adapted to release steam from the boiler at a steam pressure lower than the pressure developed during high pressure operation of the boiler. An electrically operated control valve is provided for selectively connecting the low pressure relief valve to the boiler, and the valve is controlled for precluding connection of the low pressure relief valve to the boiler until the steam pressure in the boiler drops below the relief pressure of the low pressure relief valve.

11 Claims, 2 Drawing Figures

LOW PRESSURE RELIEF VALVE ASSEMBLY FOR HIGH PRESSURE BOILER

FIELD OF THE INVENTION

The present invention relates to apparatus for use with a high pressure boiler to permit operation of the high pressure boiler as a low pressure boiler and includes a means for mounting low pressure relief valves on a high pressure boiler.

BACKGROUND PRIOR ART

High pressure boilers are commonly used in industry for producing steam to be used in operating machinery or in other manufacturing applications, and also for heating buildings. During the hours when manufacturing processes are shut down, the high pressure boilers may be operated as low pressure boilers to heat the buildings. Due to the operating characteristics and potential hazards attendant to the operation of a high pressure boiler, in some areas safety requirements dictate the presence of a trained certified boiler operator during operation of a high pressure boiler. Since low pressure boilers, i.e., boilers operating at less than 15 psi, are not accompanied by the same dangers, low pressure boilers do not require an operator to be in attendance.

In those cases where a high pressure boiler is employed for heat as well as in manufacturing operations, when the manufacturing equipment is not in operation and the boiler is not required to operate at high pressure and is used only as a low pressure boiler to maintain heating of a building, in some areas it is still necessary that the operator be present to insure the safe operation of the boiler. While the boiler pressure can be reduced during low load conditions such that the boiler functions as a low pressure boiler, since these boilers are not equipped with relief valves operable during low pressure operation of the boiler and since a malfunction of the boiler could result in the same dangers incident to operation as a high pressure boiler, it is still necessary in some areas to have a skilled operator present. For example, on weekends, manufacturing equipment may be shut down and the boiler may be needed only to heat the building. For heating purposes, low pressure operation of the boiler would be sufficient. However, because a failure of a high pressure boiler can be substantially more dangerous than that of a low pressure boiler, a trained operator must supervise operation of the high pressure boiler. This results in substantial labor costs which would not be incurred if the boiler could be operated as a low pressure boiler during those time periods.

SUMMARY OF THE INVENTION

The present invention provides apparatus to permit a high pressure boiler to be converted so as to be used at selected times as a low pressure boiler. This apparatus embodying the invention permits a high pressure boiler to be used, for example, on weekends as a low pressure boiler for heating applications and wherein the boiler can be operated without the presence of an operator. This can result in substantial savings of labor. This is particularly true since labor costs on weekends and during holidays are substantially higher than labor costs during normal working hours.

More specifically, the invention provides a means for attaching low pressure relief valves to a high pressure boiler. This apparatus includes means for connecting the low pressure relief valves to the boiler once the pressure of the boiler has declined to a level below the pressure where the relief valves will be actuated. This apparatus also includes means for preventing operation of the boiler as a high pressure boiler whenever the low pressure relief valves are operably connected to the boiler.

More specifically, the apparatus of the invention includes a low pressure relief valve and means for selectively connecting the low pressure relief valve to the boiler. The apparatus for connecting the low pressure relief valve to the boiler includes a spool piece or dutchman bolted to a steam outlet flange of a boiler. A low pressure relief manifold is connected to the spool piece, the low pressure relief valve manifold including at least one relief valve adapted to discharge steam into the atmosphere in the event the pressure of the boiler reaches the selected level. The apparatus also includes a valve operably positioned between the boiler and the low pressure relief valve and operable to selectively connect the low pressure relief valve to the boiler.

In a preferred embodiment of the invention, the control valve can comprise a butterfly valve, and an electrical actuator is provided for opening and closing the butterfly valve.

A control means is also provided for controlling the operation of the control valve and for controlling the operation of the boiler in response to the position of the control valve. The control means functions such that after the boiler operator converts from high pressure operation to low pressure operation and when the pressure of the boiler is decreased to a level below the limit of the low pressure relief valve, the motor controlling the valve will cause the valve to be opened thereby connecting the low pressure relief valve to the boiler.

In a preferred form of the invention, means are also provided for precluding operation of the boiler as a high pressure boiler when the low pressure control valve is open.

The boiler also includes a control means for controlling the heat supplied to the boiler and for thereby controlling the amount of steam generated by the boiler. The means for precluding operation of the boiler includes a control means operably connecting the low pressure valve motor to the boiler control apparatus for precluding operation of the boiler at high pressure levels whenever the low pressure relief valves are connected to the boiler.

In a preferred form of the invention means are also provided for causing the low pressure valve to close whenever the boiler operation is switched to high pressure operation. This means includes means for precluding high pressure operation until the control valve is fully closed and sends a signal to the boiler control circuit.

Various other features and advantages of the invention will be apparent by reference to the following description of a preferred embodiment, from the drawings and from the claims.

Figure 1:
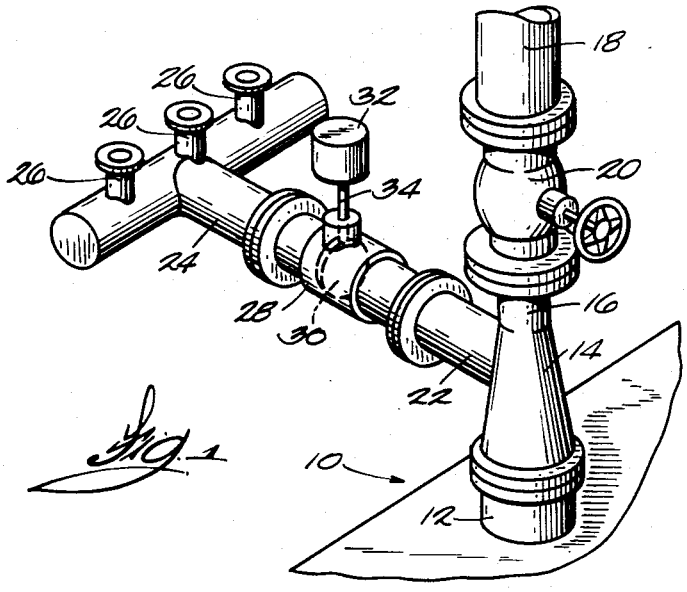
FIG. 1 is a perspective view of apparatus embodying the invention mounted on a boiler.

Before describing a preferred embodiment of the invention in detail, it is to be understood that the application is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a boiler 10 of the type which can be used in either high or low pressure operation. In the illustrated construction a steam outlet flange 12 extends upwardly from the top of the boiler 10, and a spool piece or dutchman 14 is bolted to the steam outlet flange 12. The spool piece 14 comprises a "T". One leg 16 of the spool piece is connected to a steam supply line 18 through a manual shutoff valve 20. The other leg 22 of the spool piece 14 supports a low pressure relief valve manifold 24. In the illustrated construction the manifold 24 includes three low pressure relief valves 26. The low pressure relief valves 26 are of conventional construction and will not be described in detail. Also included is a low pressure relief control valve 28 between the manifold 24 and the boiler 10 and providing a means for selectively connecting the manifold 24 to the boiler 10. Generally the control valve 28 is provided to isolate the low pressure relief valves 26 from the boiler 10 during high pressure operation of the boiler and connects the low pressure relief valves 26 to the boiler during low pressure operation.

In a preferred form of the invention, the control valve 28 will comprise a conventional butterfly valve having a rotatable valve member 30, and means are also provided for causing the rotatable valve member 30 to open or close. While the valve 28 could have other constructions and while other means could be provided for operating the valve 28, in the illustrated arrangement a conventional electrical actuator 32 is connected to the valve stem 34 to rotate the valve stem 34 between the open and closed positions.

Figure 2:
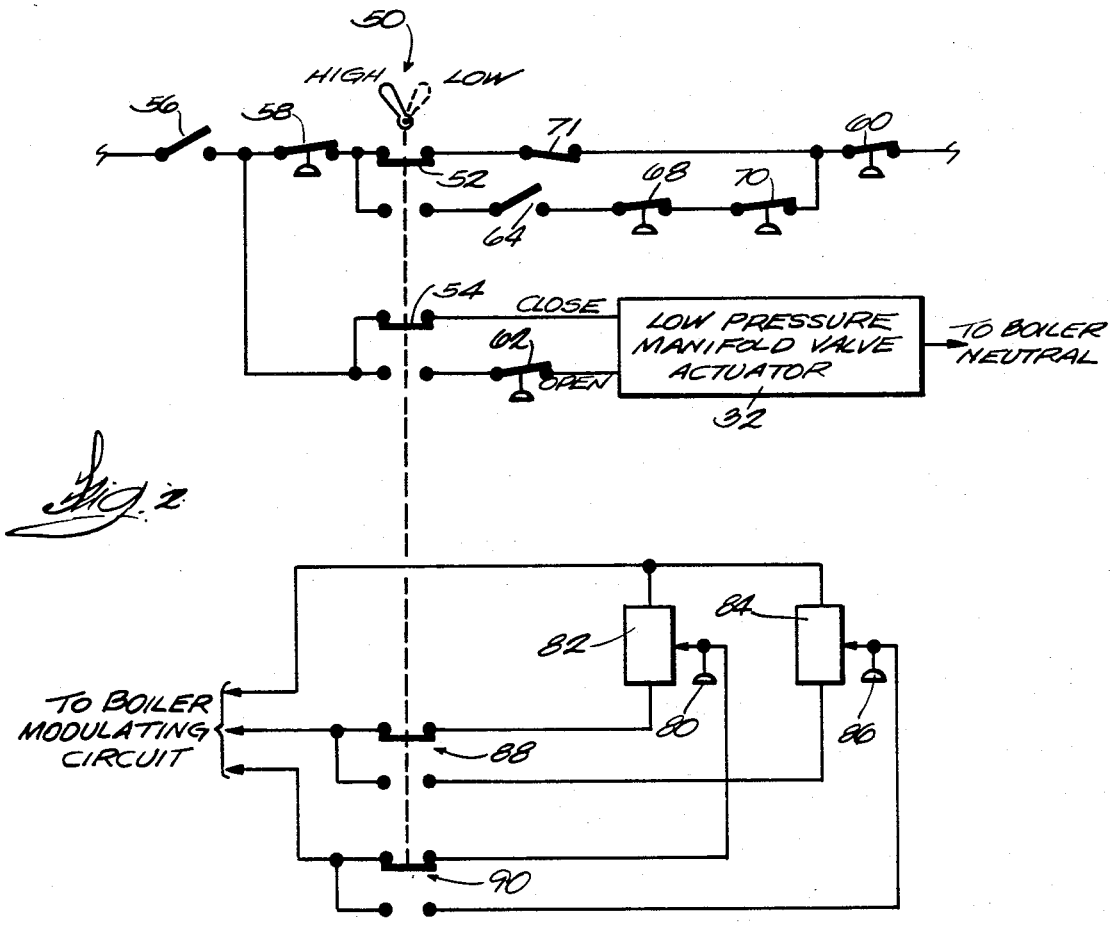
FIG. 2 is a schematic view of a control apparatus for use in controlling operation of the boiler and the low pressure relief valve control means illustrated in FIG. 1.

FIG. 2 comprises a schematic illustration of the control apparatus embodied in the present invention. A switch 50 is provided for switching between high pressure or low pressure operation of the boiler. When the operator moves the switch 50 to the high pressure operation mode, the contact 52 will be in the solid line position shown in FIG. 2, and contact 54 will similarly be in the solid line position. FIG. 2 also illustrates a switch 56 for controlling the operation of the boiler burner. Also included is a conventional high pressure operating limit control switch 58 operably connected to a pressure sensor in a pressure control pipe of the boiler and for maintaining the pressure in the boiler between selected operating limits during high pressure operation of the boiler. Also included is a conventional auxiliary or backup switch 60 intended to shut down the boiler if the pressure in the boiler should rise above a selected upper or maximum value.

The control apparatus also includes circuitry operably connecting the switch 50 to the actuator of the low pressure manifold valve 28. A conventional pressure sensitive switch 62 in the boiler control piping closes when the pressure in the boiler 10 drops below the setting of the low pressure relief valves 26. When the switch 50 is moved to the low pressure setting and when the switch 62 closes or makes contact after the pressure in the boiler has dropped to a pressure below the setting of the low pressure relief valve 26, the actuator 32 will then cause the low pressure relief manifold valve 28 to open.

Means are also provided for causing the boiler 10 to operate to maintain low pressure operation of the boiler once the manifold valve 28 has opened. This means includes a low pressure manifold valve auxiliary switch 64. This switch 64 makes contact once the valve member 30 has moved to its fully opened position. Also included is a conventional low pressure operating limit control switch 68 operably connected to a pressure sensor in the boiler control piping and for controlling operation of the boiler burner so that the pressure in the boiler remains within a range of predetermined pressures for low pressure operation. A backup switch 70 is also provided for interrupting operation of the burner in the event the pressure in the boiler rises above a selected upper level for low pressure operation.

When the boiler 10 is again to be used in high pressure applications, the operator moves the switch 50 and contacts 52 and 54 to their solid line positions. This causes the low pressure manifold valve actuator 32 to close the manifold valve 28. When the low pressure manifold valve is fully closed, the switch 71 will then make contact and permit operation of the boiler 10 in the high pressure operating mode.

Means are also provided for controlling the operation of the boiler burner firing rate during high pressure operation of the boiler. The boiler includes a conventional modulating circuit to control the boiler burner firing rate operation. A pressure sensor 80 in the boiler control piping is operably connected to a high pressure firing rate controller 82, and the high pressure controller firing rate 82 provides signals to the modulating circuit so as to cause the burner to provide controlled heating of the water in the boiler. This arrangement of the modulating circuit and firing rate controller 82 responsive to a pressure sensor 80 so as to maintain the pressure in a boiler within predetermined limits is conventional and will not be described in detail.

Additional and alternative means are also provided for controlling the firing rate of the boiler burner when the boiler is switched to low boiler pressure operation. This means includes a firing rate controller 84 connected to the boiler modulating circuit and responsive to a pressure sensor 86 in the same manner as the controller.

A pair of contacts 88 and 90 of switch 50 are provided for selectively connecting either the firing rate controller 82 or the firing rate controller 84 to the boiler modulating circuit. When the boiler is in the high pressure mode, the contacts 88 and 90 are in the solid line position shown in FIG. 2 and the firing rate controller 82 is connected to the modulating circuit. When the boiler is in the low pressure condition, the contracts 88 and 90 are in the phantom line position shown in FIG. 2 thereby disconnecting the firing rate controller 82 from the modulating circuit and connecting the firing rate controller 84 to the modulating circuit.

Various features of the invention are set forth in the following claims.

I claim:

1. Apparatus for providing for low pressure operation of a high pressure boiler, the high pressure boiler including a high pressure relief valve, a boiler burner, and means for controlling operation of the boiler burner to provide for high pressure operation of the boiler, the apparatus comprising:

a low pressure relief valve mounted on the boiler and adapted to release steam from the boiler at a steam pressure lower than the pressure developed during high pressure operation of the boiler, means for selectively connecting said low pressure relief valve to the boiler.

2. Apparatus as set forth in claim 1 wherein said means for selectively connecting said low pressure relief valve to the boiler includes means for precluding connection of said low pressure relief valve to the boiler until the steam pressure in the boiler drops below said steam pressure lower than the pressure developed during high pressure operation of the boiler.

3. Apparatus as set forth in claim 1 wherein said means for selectively connecting said low pressure relief valve to the boiler includes a butterfly valve and an electrical valve actuator connected to the butterfly valve and providing means for opening and closing the butterfly valve.

4. Apparatus as set forth in claim 1 wherein said means for selectively connecting said low pressure relief valve to the boiler includes means for precluding high pressure operation of the boiler when the low pressure relief valve is operably connected to the boiler.

5. Apparatus as set forth in claim 4 wherein said means for precluding high pressure operation of the boiler includes a switch operably connected to said butterfly valve, said switch being actuated when said butterfly valve is fully closed.

6. Apparatus as set forth in claim 5 wherein said apparatus further includes means for causing said boiler to operate at a steam pressure lower than the steam pressure generated during the high pressure operation of the boiler, said means for causing said boiler to operate at a lower steam pressure including a switch operably connected to said movable valve member, said switch being actuated when said movable valve member is fully open.

7. Apparatus for use in selectively converting a high pressure boiler to be used temporarily as a low pressure boiler, the apparatus of the invention comprising a low pressure relief valve adapted to be connected to a boiler, and means for selectively connecting said low pressure relief valve to the boiler once the pressure of the boiler has declined to a level below the pressure where the low pressure relief valves will be actuated, said means for selectively connecting the low pressure relief valve to the boiler including a conduit secured to the boiler, a low pressure relief manifold is connected to said conduit, the low pressure relief valve manifold including at least one relief valve adapted to discharge steam into the atmosphere in the event the pressure of the boiler reaches the selected level, and a control valve operably positioned between the conduit and the low pressure relief valve and operable to alternatively selectively connect the low pressure relief valve to the boiler.

8. An apparatus as set forth in claim 7 wherein said control valve comprises a butterfly valve, and wherein said means for selectively connecting the low pressure relief valve to the boiler includes an electrical actuator for opening and closing the butterfly valve.

9. Apparatus as set forth in claim 7 and further including a control means for controlling the operation of the control valve and for controlling the operation of the boiler in response to the position of the control valve, the control means causing the control valve to be opened thereby connecting the low pressure relief valve to the boiler when the pressure of the boiler is decreased to a level below the relief pressure of the low pressure relief valve.

10. Apparatus as set forth in claim 7 wherein said means for selectively connecting includes means for precluding operation of the boiler as a high pressure boiler when the low pressure control valve is open.

11. Apparatus as set forth in claim 7 wherein said means for selectively connecting includes means for causing the low pressure valve to close whenever the boiler operation is switched to high pressure operation.

* * * * *